United States Patent [19]

Ihle

[11] 4,147,079

[45] Apr. 3, 1979

[54] APPARATUS FOR HANDLING STRIP

[75] Inventor: Josef Ihle, Pforzheim, Fed. Rep. of Germany

[73] Assignee: Irma Ungerer Geb. Dollinger, Pforzheim, Fed. Rep. of Germany

[21] Appl. No.: 795,155

[22] Filed: May 9, 1977

[30] Foreign Application Priority Data

Oct. 13, 1976 [DE] Fed. Rep. of Germany ..... 2646200

[51] Int. Cl.[2] ..... D21H 1/14

[52] U.S. Cl. ..... 83/170; 83/209; 83/236; 83/367; 156/361; 156/380; 156/522; 156/552

[58] Field of Search ..... 83/209, 236, 336, 367, 83/29, 170; 156/361, 380, 522, 552; 226/42, 43

[56] References Cited

U.S. PATENT DOCUMENTS

| | | | |
|---|---|---|---|
| 2,288,716 | 7/1942 | Kahn | 226/43 |
| 2,354,120 | 7/1944 | Haren | 156/361 |
| 2,575,887 | 11/1951 | Nitchie | 156/361 |
| 3,112,055 | 11/1963 | Hartley | 156/361 X |
| 3,657,051 | 4/1972 | McCarthy | 156/361 X |
| 3,811,304 | 5/1974 | Gorker | 226/42 X |
| 3,933,564 | 1/1976 | Jensen | 156/552 X |

*Primary Examiner*—J. M. Meister

[57] ABSTRACT

First feeding means serve to deliver a first strip at a controlled velocity. Second feeding means serve to receive said first strip from said feeding means and to intermittently pull said first and second strips in contact with each other. Looping means serve to engage said first strip between said first and second feeding means and to urge said strip to form a loop. Sensing means serve to indicate the length of said loop. Control means serve to control the velocity at which said first strip is delivered by said first feeding means in response to said sensing means in inverse relation to the length of said loop. In preferred embodiments, the looping means comprise a looping roller arranged to engage said first strip between said first and second feeding means and to urge said first strip to form a loop, said sensing means comprise a lever carrying said looping roller and arranged to perform an angular movement in response to a change of the length of said loop and said control means comprise a tachometer generator for producing a tachometer output voltage representing the speed of said motor, a potentiometer mechanically coupled to said lever and serving to produce a potentiometer output voltage representing the position of said lever, a comparator for producing a comparator output voltage which represents the difference between said tachometer output voltage and said potentiometer output voltage, and a motor controller for controlling the speed of said motor in dependence on said comparator output voltage. The first feeding means include the motor.

19 Claims, 7 Drawing Figures

Figure 1:
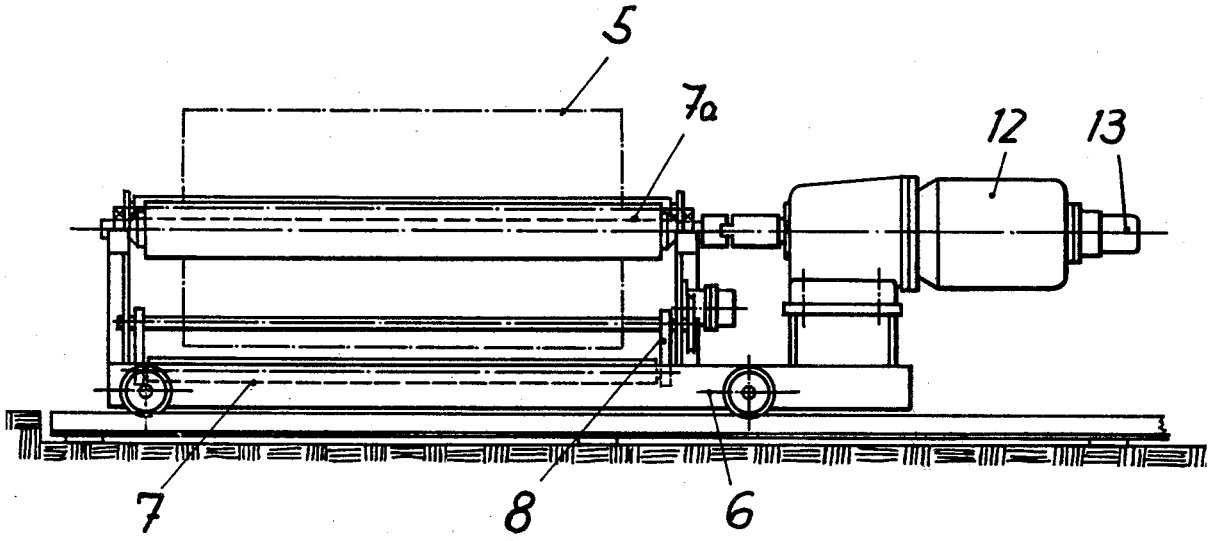

Fig. 2a
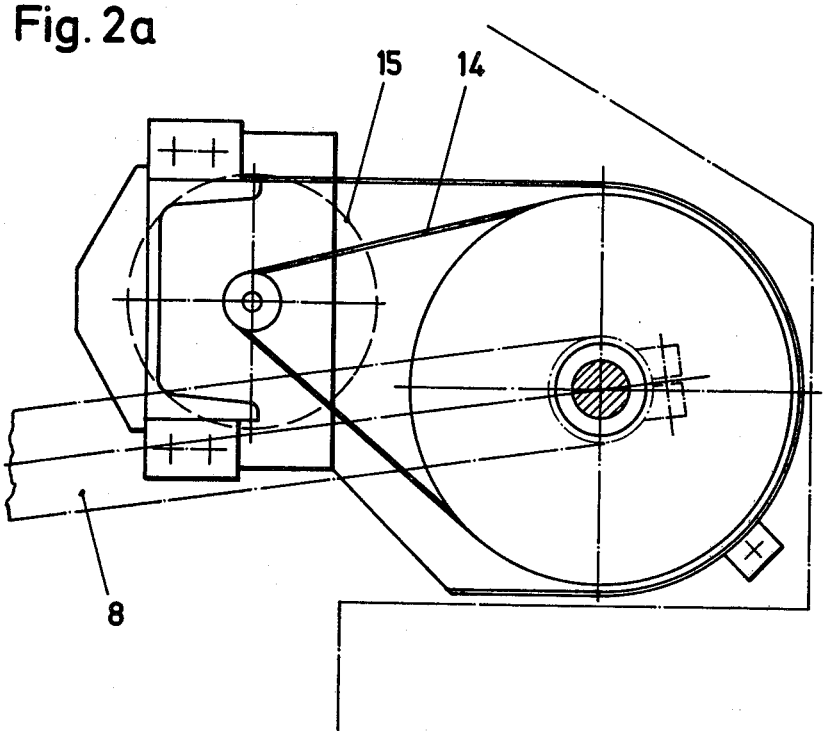
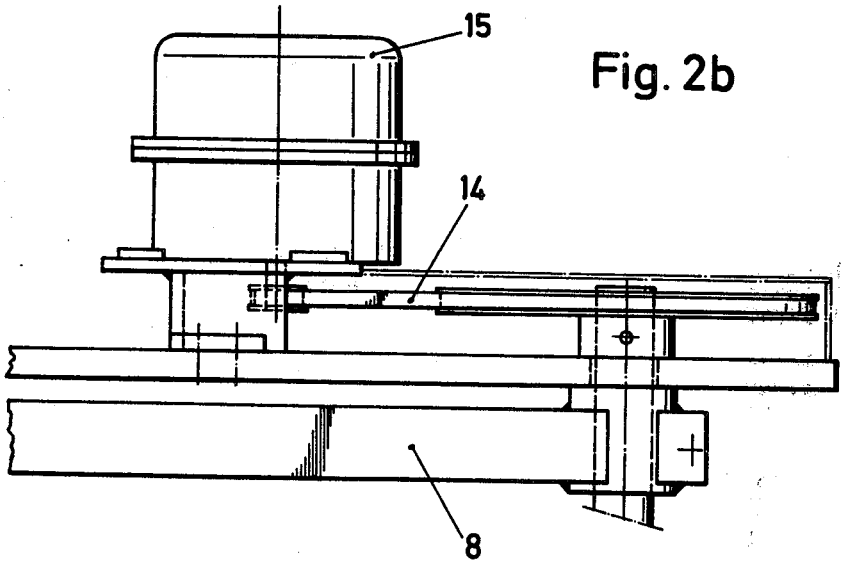
Fig. 2b

APPARATUS FOR HANDLING STRIP

This invention relates to apparatus for handling strip.

U.S. Pat. No. 3,318,751 describes apparatus for adhesively connecting a paper strip to a continuous metal strip. In that known apparatus, the paper strip and metal strip are jointly pulled by feed rollers and delivered to cross-cutting shears, which cut the strip into plates, which are subsequently stacked in alternation with interlayers formed by the paper. Before the paper strip contacting the metal strip reaches the cross-cutting shears, electrostatic charges are applied to the paper strip so as to establish electric fields which act on the paper strip and metal strip to retain the paper strip in contact with the metal strip for a short time until said electric fields have been automatically dissipated.

In accordance with German Pat. No. 1,245,253, the charges are applied to the paper by pointed corona discharges electrodes, which are accomodated in the feed rollers for pulling the metal strip and paper strip so that said rollers serve also as corona discharge electrodes. In accordance with German Pat. No. 1,152,294, said feed and corona discharge rollers are preceded by heated rollers, which serve to dry the paper in order to avoid an excessively fast dissipation of the charges by paper which has absorbed moisture from the ambient air.

It is an object of the present invention to provide apparatus which embodies the teachings of one or more of the patent specifications referred to hereinbefore and which can be used with strip-feeding means which are adapted to be operable in successive cycles comprising starting up from standstill after a cross-cutting operation and retarding to a standstill for a succeeding cross-cutting operation in such a manner that the paper strip is not torn in spite of the rapid speed changes to which it is subjected.

In apparatus for adhesively connecting a paper strip to a continuous metal strip, in which the paper strip and metal strip are jointly pulled by feed rolls and delivered to cross-cutting shears, which cut the strip into plates, which are subsequently stacked in alternation with interlayers formed by the sheets into which the paper strip has been cut and in which electrostatic charges are preferably applied to the paper strip so as to establish electric fields, which act on the paper strip and metal strip to retain the paper strip in contact with the metal strip for a short time until said electric fields have been automatically dissipated, said charges are preferably applied to the paper by a corona discharge electrode, which is preceded by heated rollers for drying the paper and which apparatus is intended for use with strip-feeding means operable in successive cycles comprising starting up from standstill after a cross-cutting operation and retarding to a standstill for a succeeding cross-cutting operation, said object is accomplished in that the paper strip is caused to form a loop around a roller carried by a sensing lever between a reel-mounted coil of paper strip and guide rollers for guiding said paper toward said metal strip, which guide rollers consist preferably of said heated rollers and/or corona discharge rollers, and said lever cooperates with a controller for a drive motor for means for withdrawing said paper strip from said coil in such a manner that the advance of said paper can be accelerated and retarded in dependence on the advance of said metal strip. Under the action of gravity or of a tension spring, the sensing lever tensions the loop formed by the paper strip and in response to a shortening or lengthening of the loop controls the motor speed so as to effect a compensation.

Further details of the apparatus according to the invention, particularly with respect to the control means, will be described with reference to the drawing, which shows an embodiment by way of example.

Figure 2:
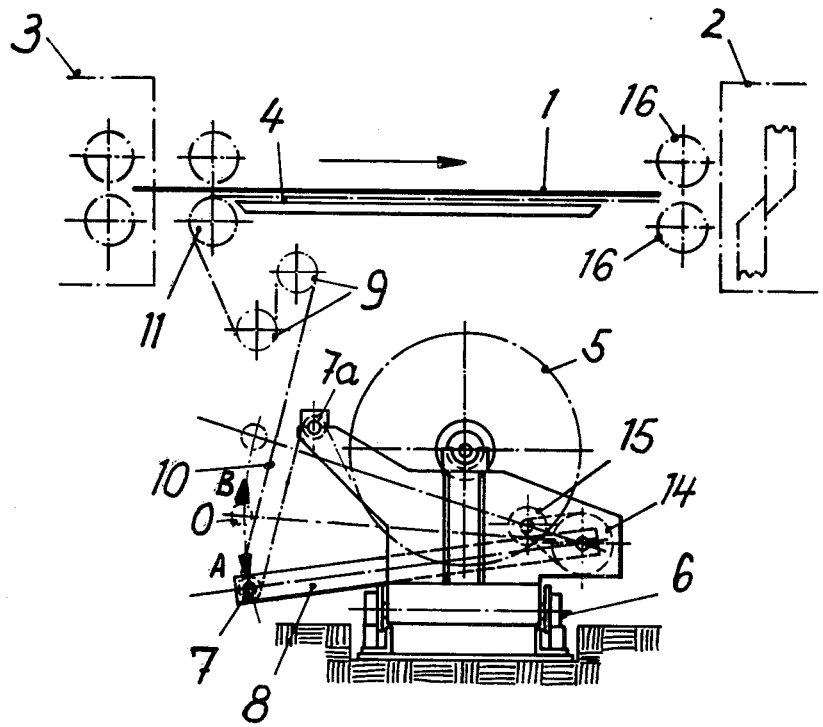
Figure 3:
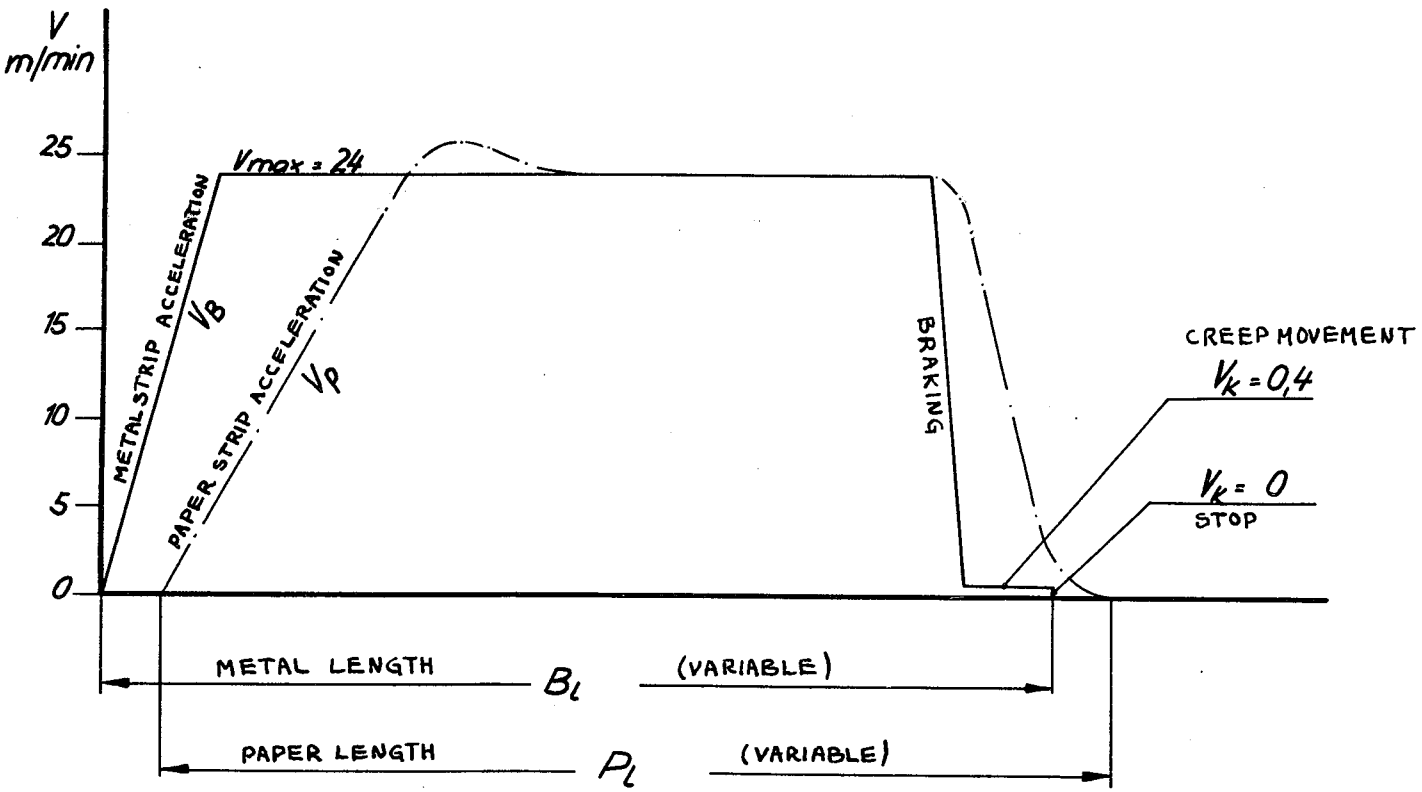
Figure 4:
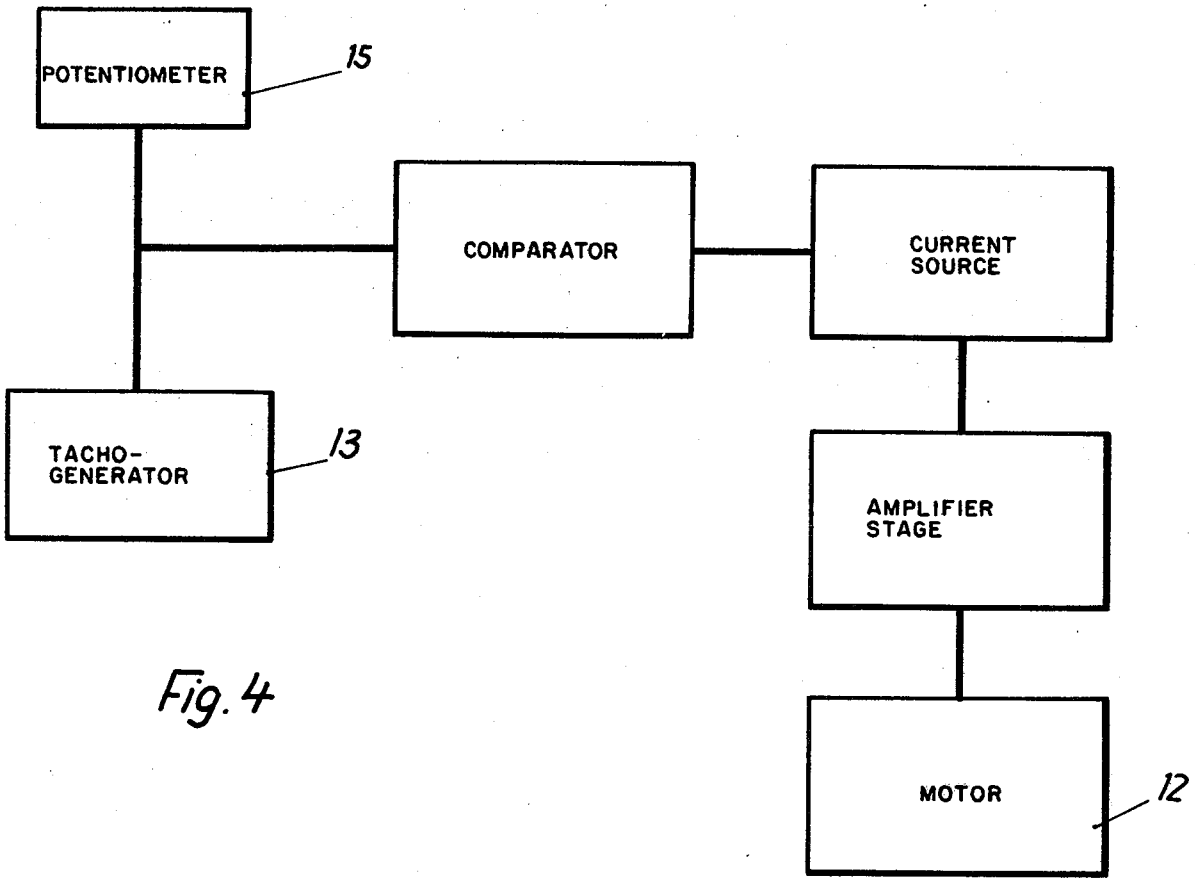
Figure 4A:
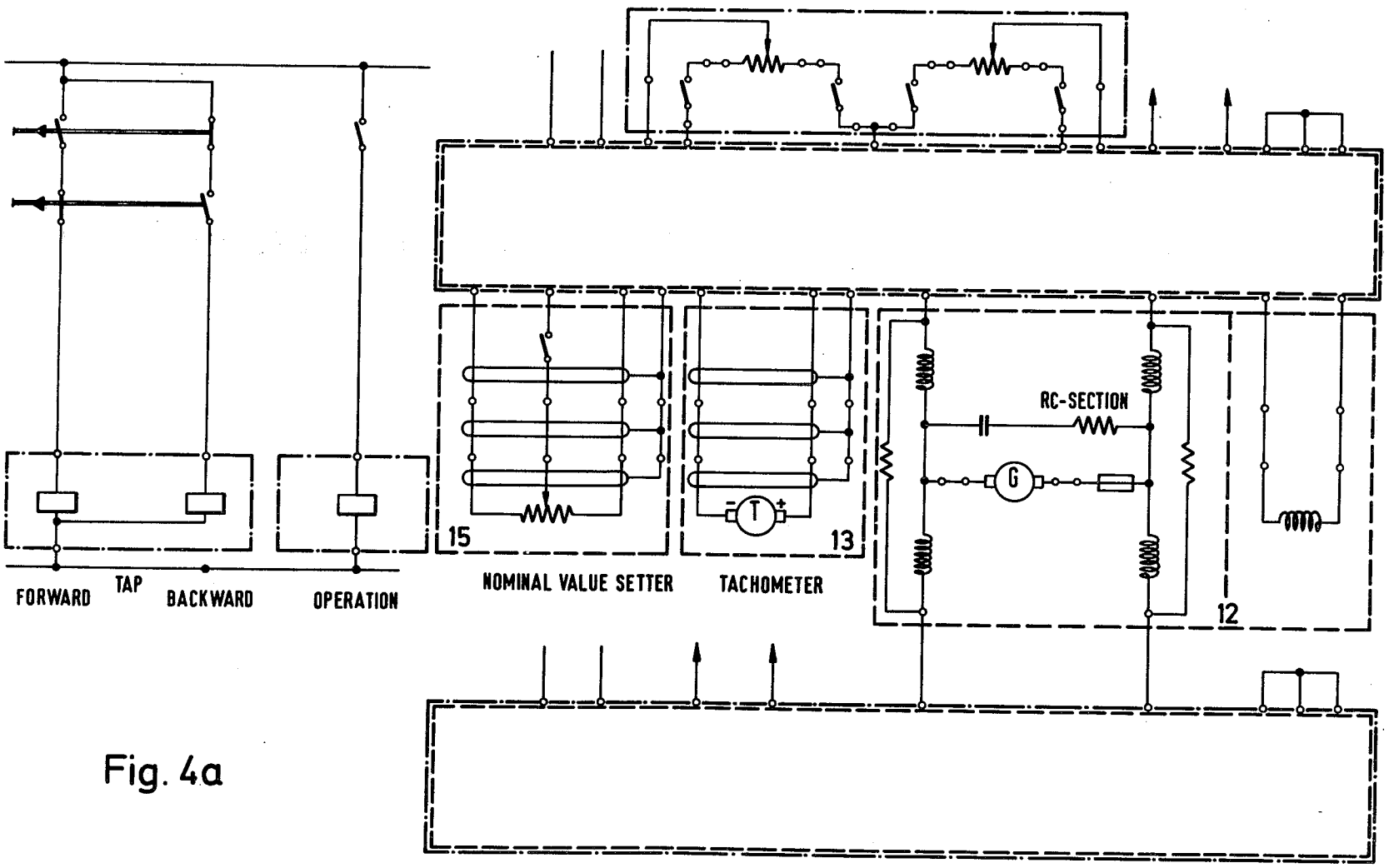

FIGS. 1 and 2 are, respectively, a general front elevation, and a side elevation diagrammatically showing such apparatus, FIG. 2*a* is an enlargement of a portion of FIG. 2 showing the belt drive coupling, FIG. 2*b* is a top view of FIG. 2*a*, FIG. 3 is a diagram illustrating the operation of the means for feeding the metal strip the paper strip, and FIG. 4 is a block circuit diagram of the means for controlling the means for feeding the paper strip, and FIG. 4*a* is a switching circuit diagram illustrating in detail the block circuit diagram of FIG. 4.

A metal strip 1 is delivered by a strip-withdrawing and levelling machine 3 and is fed to a stationary shearing machine 2. A paper strip 4 is withdrawn from a coil 5 mounted on a reel truck 6, which is movable transversely to the metal strip to a position under the metal strip between the machine 3 and 2. The paper strip 4 withdrawn from the paper reel 5 is trained around a feed roller 7*a* and then around a looping roller 7 carried by a sensing lever 8 and is then advanced to two heated deflecting rollers 9 so that the paper strip forms a loop 10. From the heated deflecting rollers 9, the paper strip advances to and around a corona discharge and feed roll 11 and is then applied to the underside of the metal strip 1, as is apparent from the drawing.

The metal strip 1 and the paper strip 4, which retained to the metal strip by the electrostatic charges applied, are fed to the stationary shears 2 by preceding feed rolls 16, which are coupled to the means for driving the shears. The metal plates or sheets severed from the strip 1 by the shears 2 and sheets of paper severed from the paper strip 4 are stacked in alternation on stacking cars.

The reel car 6 carries a drive motor 12 for driving the feed roller 7*a* to withdraw the paper strip 4 from the coil 5 so that said coil and reel which carries it are driven too. The motor 12 is provided with a tachometer generator 13. The control lever 8 is operatively connected by a speed-increasing belt drive or transmission 14 to the shaft 15 of a potentiometer 15. To control the paper loop 10, the output voltage of the potentiometer corresponding to the angular position of the potentiometer shaft 15 is compared with the output voltage of the tachometer generator 13. With reference to FIG. 2, the sensing lever 8 is normally in a position designated zero and in response to an increase of the length of the loop 10 performs a downward movement indicated by an arrow A and in response to a decrease of the length of the loop 10 performs an upward movement represented by an arrow B. The arrangement is such that the speed of the drive motor 12 is decreased in response to the downward movement indicated by the arrow A and is increased in response to the upward movement indicated by the arrow B. This is represented by the velocity curves for the metal strip and paper strip shown in FIG. 3. As a result, the variation of the velocity $V_P$ of the paper strip substantially conforms to the variation of the velocity $V_B$ of the metal strip between successive cuts so that a tearing of the paper strip is avoided.

During each cycle, the paper coil 5 is braked to be at a standstill at the time of the cut and subsequently until the advance of the metal strp 1 and of the paper strip 4 adhering thereto has been resumed so that the loop 10 is decreased in length and the sensing lever 8 has been raised to cause the motor 12 to start up.

The velocity of the metal strip 1 is controlled in dependence on the length of the plates to be cut in such a manner that the velocity of the metal strip is reduced to a creep movement shortly before the cut and to a standstill immediately before the cut so that the metal strip is cut into plates having exactly a predetermined length.

As has been described hereinbefore, the motor 12 for withdrawing the paper strip from the coil 5 is controlled in the manner described hereinbefore by a computer which comprises a comparator V, in which the output voltages of the potentiometer P having the shaft 15 and of the tachometer generator T or 13 are compared, as is apparent from the block circuit diagram shown in FIG. 4, which shows also that the output of the comparator V is delivered via a motor controller to the drive motor M, which is designated 12 in FIG. 1. The motor controller comprises a current controller stage S connected to the comparator V and an output amplifier stage L connected to the drive motor M.

What is claimed is:

1. Apparatus for continuously handling first and second strips in contact with each other, comprising first feeding means for delivering said first strip at a controlled velocity, second feeding means for receiving said first strip from said first feeding means and for intermittently pulling and delivering said first and second strips in contact with each other, looping means for engaging said first strip between said first and second feeding means and for urging said strip to form a loop, sensing means for indicating the length of said loop, a looping roller arranged to engage said first strip between said first and second feeding means and to urge said first strip to form a loop, a lever carrying said looping roller and arranged to perform an angular movement in response to a change of the length of said loop, and control means for controlling the velocity at which said first strip is delivered by said first feeding means in response to said lever, in inverse relation to the length of said loop, said first feeding means comprising a drive motor and said control means being adapted to accelerate and brake said motor in response to said lever.

2. Apparatus as set forth in claim 1, which comprises stationary shears for receiving said first and second strips in contact with each other from said second feeding means and for cross-cutting said first and second strips in contact with each other so as to sever sheets therefrom when said second feeding means are arrested.

3. Apparatus as set forth in claim 2, for use when one of said strips consists of electrostatically chargeable material, which comprises charging means for setting up electrostatic charges in said one strip between said looping roller and said shears, said charges being sufficient to maintain said first and second strips in contact with each other once said contact has been established.

4. Apparatus as set forth in claim 3, for use when the other of said strips consists of electrically conducting material tending to dissipate said electrostatic charges, in which said shears are arranged to cross-cut said first and second strips as long as said electrostatic charges are sufficient to maintain said first and second strips in contact with each other.

5. Apparatus as set forth in claim 3, for use when said first strip consists of electrostatically chargeable material, in which a charging roller is arranged to contact said first strip between said looping roller and said second feeding means and said charging means comprise corona discharge electrode means incorporated in said charging roller.

6. Apparatus as set forth in claim 5, for use when said first strip consists of a material which contains moisture, in which a heated roller is arranged to contact said first strip between said looping roller and said charging roller to evaporate moisture from said first strip.

7. Apparatus as set forth in claim 1, for use when said strip consists of electrostatically chargeable material, which comprises charging means for setting up electrostatic charges in said first strip between said looping roller and said second feeding means, said charges being sufficient to maintain said first and second strips in contact with each other once said contact has been established.

8. Apparatus as set forth in claim 7, for use when said first strip consists of a material which contains moisture, in which a heated roller is arranged to contact said first strip between said looping roller and said charging means to evaporate moisture from said first strip.

9. Apparatus as set forth in claim 1, in which a reel is provided, which is adapted to carry a coil of said first strip, and said first feeding means are operable to withdraw said first strip from said coil.

10. Apparatus as set forth in claim 1, in which said looping roller is weight-biased against said first strip to tension the same.

11. Apparatus as set forth in claim 1, further comprising spring means urging said looping roller against said first strip to tension the same.

12. Apparatus as set forth in claim 1, in which said control means are arranged to stop said second feeding means when said lever indicates a predetermined length of said loop.

13. Apparatus for continuously handling first and second strips in contact with each other, comprising first feeding means for delivering said first strip at a controlled velocity, second feeding means for receiving said first strip from said first feeding means and for intermittently pulling and delivering said first and second strips in contact with each other, looping means for engaging said first strip between said first and second feeding means and for urging said strip to form a loop, sensing means for indicating the length of said loop, control means for controlling the velocity at which said first strip is delivered by said first feeding means in response to said sensing means in inverse relation to the length of said loop, said first feeding means comprising a motor, said looping means comprising a looping roller arranged to engage said first strip between said first and second feeding means and to urge said first strip to form a loop, said sensing means comprising a lever carrying said looping roller and arranged to perform an angular movement in response to a change of the length of said loop, said control means comprising a tachometer generator for producing a tachometer output voltage representing the speed of said motor, a potentiometer serving to produce a potentiometer output voltage representing the position of said lever, said potentiometer having a shaft which is rotatable to change said potentiometer output voltage, a speed-increasing transmission arranged to transmit said angular movement of said lever to said shaft, a comparator for producing a comparator output voltage which represents the difference between said tachometer output voltage and said potentiometer output voltage, and a motor controller for controlling the speed of said motor in dependence on said comparator output voltage.

14. Apparatus as set forth in claim 13, in which said speed-increasing transmission comprises a belt drive.

15. Apparatus as set forth in claim 13, in which said motor controller comprises a current controller which is responsive to said comparator output voltage, and an amplifier having an output connected to said motor.

16. Apparatus as set forth in claim 13, in which said control means are arranged to stop said motor when said lever is in a predetermined angular position.

17. Apparatus for handling strip, comprising first feeding means for delivering strip at a controlled velocity, second feeding means for receiving said strip from said first feeding means and for intermittently pulling said strip, looping means for engaging said strip between said first and second feeding means and for urging said strip to form a loop, sensing means for indicating the length of said loop, control means for controlling the velocity at which said strip is delivered by said first feeding means in response to said sensing means in inverse relation to the length of said loop, said first feeding means comprising a motor, said looping means comprising a looping roller arranged to engage said strip between said first and second feeding means and to urge said strip to form a loop, said sensing means comprising a lever carrying said looping roller and arranged to perform an angular movement in reponse to a change of the length of said loop, and said control means comprising a tachometer generator for producing a tachometer output voltage representing the speed of said motor, a potentiometer serving to produce a potentiometer output voltage representing the position of said lever, a belt drive arranged to transmit said angular movement of said lever to said potentiometer, a comparator for producing a comparator output voltage which represents the difference between said tachometer output voltage and said potentiometer output voltage, and a motor controller for controlling the speed of said motor in dependence on said comparator output voltage.

18. Apparatus as set forth in claim 17, in which a reel is provided, which is adapted to carry a coil of said strip, and said first feeding means are operable to withdraw said strip from said coil.

19. Apparatus as set forth in claim 17, in which said control means are arranged to stop said motor when said lever is in a predetermined angular position.

* * * * *